United States Patent [19]

Slater

[11] Patent Number: 4,641,468

[45] Date of Patent: Feb. 10, 1987

[54] PANEL STRUCTURE AND BUILDING STRUCTURE MADE THEREFROM

[75] Inventor: Jack Slater, Islington, Canada

[73] Assignee: Cano International, N.V., Curacao, Netherlands

[21] Appl. No.: 771,030

[22] Filed: Aug. 30, 1985

Related U.S. Application Data

[63] Continuation of Ser. No. 442,110, Nov. 16, 1982, abandoned, which is a continuation-in-part of Ser. No. 300,460, Sep. 9, 1981, abandoned, which is a continuation-in-part of Ser. No. 272,162, Jun. 10, 1981, abandoned, which is a continuation-in-part of Ser. No. 43,568, May 29, 1979, abandoned.

[51] Int. Cl.[4] ..... E04C 1/00

[52] U.S. Cl. ..... 52/309.4; 52/309.9; 52/309.7; 52/586

[58] Field of Search ..... 52/582, 282, 264, 309.7, 52/309.4, 309.9, 309.16, 586, 582, 585

[56] References Cited

U.S. PATENT DOCUMENTS

| | | | |
|---|---|---|---|
| 1,013,385 | 1/1912 | George | 52/582 |
| 2,187,148 | 1/1940 | Fisher | 52/264 |
| 3,228,158 | 1/1966 | Russell | 52/586 |
| 3,230,681 | 1/1966 | Allen | 52/309.9 |
| 3,350,828 | 11/1967 | Russell | 52/282 |
| 3,353,315 | 11/1967 | Barker | 52/586 |
| 3,363,383 | 1/1968 | La Barge | 52/285 |
| 3,439,465 | 4/1969 | Du Pre | 52/282 |
| 3,594,028 | 7/1971 | Scott | 52/582 |
| 3,632,149 | 1/1972 | Konig | 52/582 |
| 3,760,551 | 9/1973 | König | 52/285 |
| 3,782,049 | 1/1974 | Sachs | 52/309.7 |
| 3,885,367 | 5/1975 | Thunberg | 52/282 |
| 3,965,958 | 6/1976 | Kump | 52/586 |
| 4,032,680 | 6/1977 | Allard | 52/309.7 |
| 4,163,349 | 8/1979 | Smith | 52/586 |
| 4,223,500 | 9/1980 | Clark | 52/584 |
| 4,284,447 | 8/1981 | Pickens | 52/309.7 |
| 4,428,991 | 1/1984 | Kamstrup-Larsen | 52/586 |
| 4,435,928 | 3/1984 | Huling | 52/90 |

FOREIGN PATENT DOCUMENTS

| | | | |
|---|---|---|---|
| 2332778 | 1/1974 | Fed. Rep. of Germany | 52/309.7 |

*Primary Examiner*—Henry E. Raduazo

*Attorney, Agent, or Firm*—Nies, Webner, Kurz & Bergert

[57] ABSTRACT

Building panel structures and methods for erecting buildings are described which utilize structural foam combined in a unique fashion with rigid framing members to provide low cost, energy efficient modular building structures which can be quickly and easily erected.

5 Claims, 45 Drawing Figures

PANEL STRUCTURE AND BUILDING STRUCTURE MADE THEREFROM

This application is a continuation of application Ser. No. 442,110 filed Nov. 16, 1982 as a continuation-in-part of application Ser. No. 300,460 filed Sept. 9, 1981 as a continuation-in-part of application Ser. No. 272,162 filed June 10, 1981 as a continuation-in-part of application Ser. No. 43,568 filed May 29, 1979, said applications now being abandoned.

This invention relates to improvements in panel structures, to improved building structures made therefrom, to methods for making and erecting such structures.

It is a principal object of the present invention to provide a building system which combines low cost on-site construction with high performance materials to create an energy-efficient building system usable under a wide variety of climatic conditions.

It is a further object of the invention to provide a building system which permits either on-site or prefabricated construction of buildings usable as residential houses, recreational units, mobile units, construction camp units, hospitals, schools, warehouses and the like.

It is a further object of the invention to provide a building system which makes possible the use of semi-skilled labor and requires no special lifting or construction equipment.

The present invention, among other things, provides a unique form of building panel structure, which panel structure is usable to form the side walls, roof, interior partitions and, optionally, the floor of a building structure.

It is a further important object of the invention to provide a unique building component comprising a composite of steel and plastic foam materials bonded together to impart to the resulting structure strength characteristics and other characteristics which are different from the characteristics of foam and steel considered separately.

A building panel structure in accordance with one aspect of the invention includes a plurality of elongated slabs of rigid structural foam insulating material to which steel reinforcing members are bonded to provide a composite structure of unique properties. In one form of the invention each slab includes a pair of major surfaces with a pair of recesses being disposed along each of the longitudinal side edges of the slab to define a tongue extending therealong, each such tongue projecting outwardly from a mid-thickness region of the slab. The slabs are disposed in side-by-side relation with the tongues of the respective slabs being in opposed abutting relationship and the adjacent recesses together defining opposed grooves located at the junctions between the slabs. A rigid framing member is disposed in each of these grooves with the opposing pairs of framing members serving to "sandwich" the abutting tongues of the adjacent slabs therebetween. The tongues of foam material serve to provide a thermal barrier between the framing members.

Preferably, each framing member comprises a tubular metal member although in some embodiments alternative structural materials such as wood or reinforced plastics could be used. Furthermore, in the preferred form of the invention, a suitable adhesive material serves to bond each framing member to the foam material next adjacent thereto.

In another form the building component comprises a slab of polystyrene or like foam material having recesses in its major surfaces in which opposed pairs of steel reinforcing members are received, the steel members being bonded to the foam material.

In this embodiment of the invention the foam slabs or panels are recessed along their edges to form a space for receiving a spline which holds two adjacent slabs or panels in assembled relation.

In a further embodiment of the invention slabs or panel of structural foam, which may take the form of the previously described embodiments, are utilized in conjunction with posts of structural foam of the same or higher density. The posts, which are rectangular or square in section, are recessed on two opposed surfaces to receive steel reinforcing members bonded in place and are recessed on two other opposed surfaces to receive splines for attachment to the main panels or slabs.

In a typical embodiment of the invention, the slabs of foam material comprise preshrunk and precut rigid polystyrene sheets. The framing members typically comprise galvanized tubular steel members. These tubes are interconnected by chemical welding to the polystyrene material. Pairs of perimeter framing members which typically comprise galvanized steel angles are fastened to the ends of the respective tubes and are chemically bonded to the foam along the perimeters of the panel structure. The system enables thermal bridging to be kept to an absolute minimum. The foam material serves to separate the pairs of framing members from one another and the steel angle members located at the perimeters of the panel are likewise spaced apart in the thickness direction of the panel thereby to avoid any substantial degree of heat flow from the interior to the exterior of the structure.

The building system of the present invention may be used with a wide variety of foundation systems as, for example, concrete slab on-grade, below grade foundations, pier supports, or granular base.

As noted above, the framework of the building system preferably comprises tubular steel. Tubular steel configurations combine high strength, stability and light weight and they may, of course, be galvanized to protect same against deterioration from corrosion. The tubular members may be of welded construction or may be roll formed. As used herein "tubular" applies to both forms. Tubular sections of the required strengths are determined depending upon the stresses and design criteria in any given location. Lateral bracing is provided to give the necessary stability against wind and earthquake loads. To achieve lateral stability against wind loads, a metal strap is installed in certain of the roof and wall panels, the gauge and width of the strap and the number of fasteners connecting same to the metal framing members of the walls and roof is determined by the anticipated wind loads on the wall and roof.

Building panels in accordance with the invention are designed to be used as floor, wall and roof systems. The panel thickness can be adjusted depending upon climatic conditions and building code requirements in the jurisdiction in which the building is being erected.

Panel structures in accordance with the invention incorporate rigid foam insulating material as a major part of the construction. The preferred material is expanded polystyrene which, as is well known, is produced from small beads that are thermally expanded and fused to form large blocks which are then cut into any desired size and thickness. Rigid foam insulation material has one of the lowest thermal conductivities of all common insulation materials thus making it a most versatile cost efficient insulation as well as providing a substantial degree of structural strength.

The invention further comprises building constructions employing building panel structures as described above for at least one of the following: side walls, roof, interior partitions, and floor.

The system of the present invention is adaptable to both pre-fabrication or on-site construction. On-site construction preferably involves building each wall panel on the previously constructed base or sub-floor. As each wall panel is completed it is raised and secured in position to the base and abutting walls. Upon completion of exterior and interior load bearing walls, the roof panels are constructed and secured to the walls. Then windows and exterior doors are positioned and exterior siding or finish applied; facia and soffit are secured followed by the application of the roofing material.

Pre-fab erection entails similar procedures as above with some variations in fastening methods. Smaller panels can be factory assembled and transported to the building site.

Insofar as the exterior and interior finishes are concerned, various fire-rated finishes can be applied to the ceiling and walls as pre-formed sheets, stucco or paint spray applications, hand brushed or trowelled finishes. Roofing may be galvanized to pre-painted steel, asphalt shingles or other similar roofing materials. Any conventional type of flooring, windows and doors can be incorporated into the building system. Glass fiber reinforced acrylic resin coatings are particularly suitable for use on the exterior and interior surfaces of the polystyrene foam slabs; however, various other types of finishes, as noted above, are also suitable.

In all embodiments of the invention the basic building component is a unique composite of steel and polystyrene or other like plastic foam material which has the capacity to take structural loads and to provide superior thermal insulation. By utilization of different cross sections and densities the foam materials and different cross sections and gauge of steel members the composite basic components may be designed to acheive precise load handling capacities.

The present invention also provides for the unique design of combinations of steel and polystyrene or other like foam plastics so that the particular cross section developed including the density and thickness of the polystyrene and the cross section and gauge of the steel members all contribute to the structural capacities of the particular section to permit the determination of the load carrying capacity of a particular composite product. The bonding or chemical welding of the foam and steel members is effected in such a manner that the members work together as a single structural element with the strength characteristics of the foam and steel working together as a single entity.

This combination of materials gives a structural strength far exceeding all existing building code requirements.

It is a further important object of the present invention to provide a building system comprising a plurality of basic modular units which may be assembled in an essentially unlimited variety of patterns and configurations to provide increased strength when necessary and to accommodate window and door openings.

In all configurations certain of the studs or framing members are maintained on 16 inch or 24 inch centers to permit the installation of standard width interior finishing panels such as wall board and standard width exterior finishing panels such as wood or metal siding.

Typical embodiments of the invention will now be described, by way of example, with reference to the accompanying drawings in which.

Figure 11:
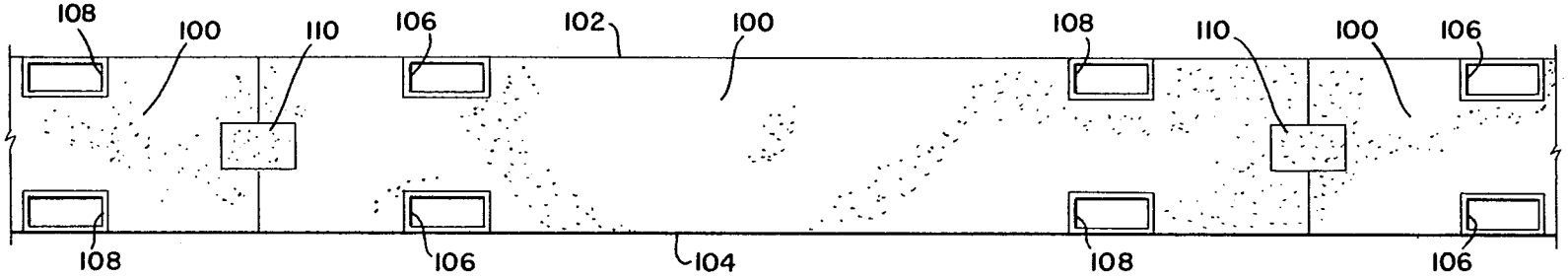
Figure 12:
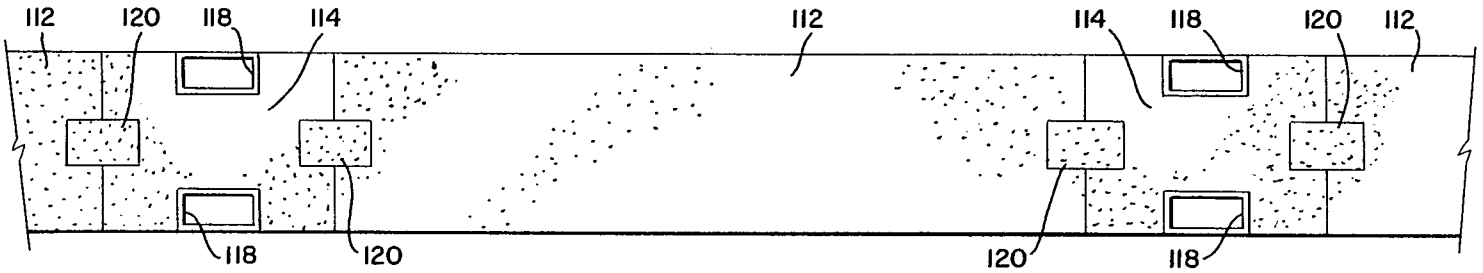
Figure 13A:
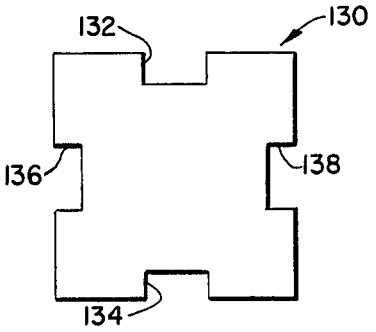
Figure 13B:
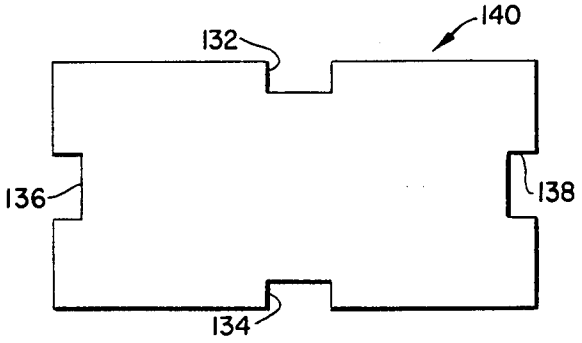
Figure 13C:
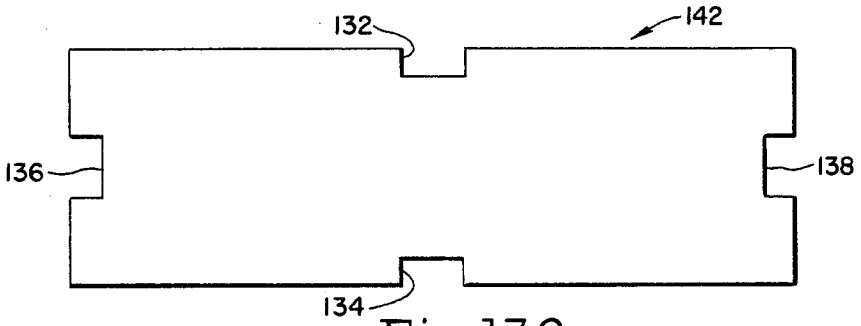
Figure 14A:
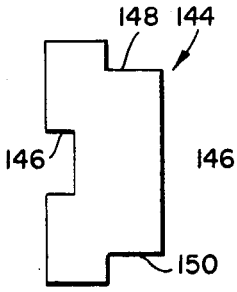
Figure 14B:
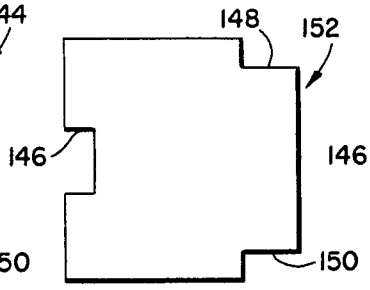
Figure 14C:
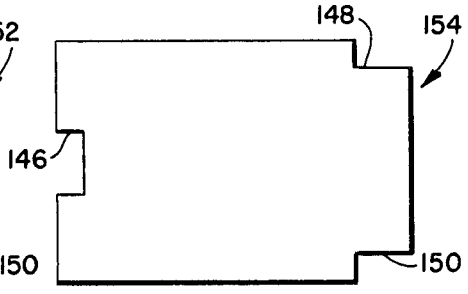

FIGS. 10A through 10D further illustrate steps in the construction of a building;

FIG. 11 is a horizontal section illustrating the basic building components constructed in accordance with a further embodiment of the invention;

FIG. 12 is a horizontal section illustrating a further embodiment of the invention comprising a unique combination of foam panels and composite posts;

FIGS. 13A through 13C are transverse section through three basic modular structural foam components;

FIGS. 14A through 14C are transverse sections of three basic modular structural foam components for use as end pieces on walls or roof sections.

Figure 15A:
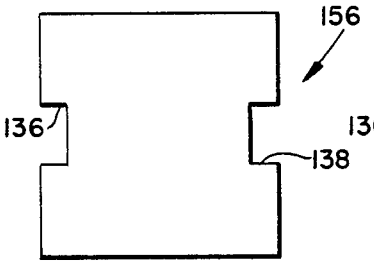
Figure 15B:
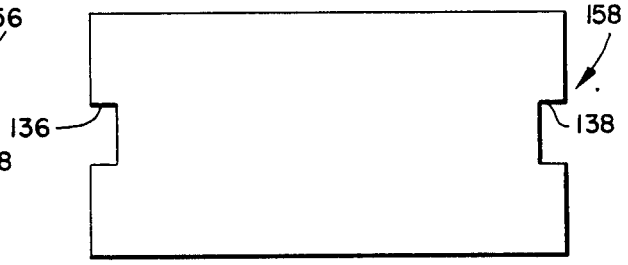
Figure 16:
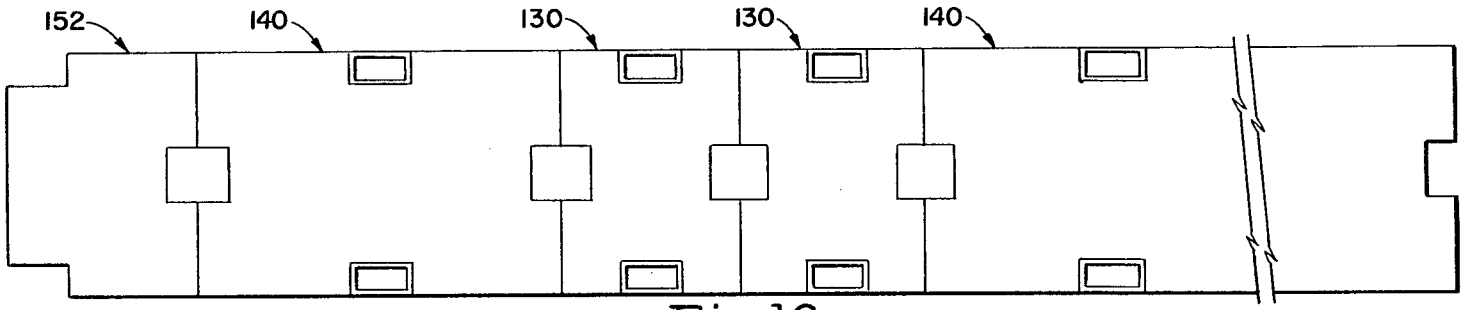
Figure 17:
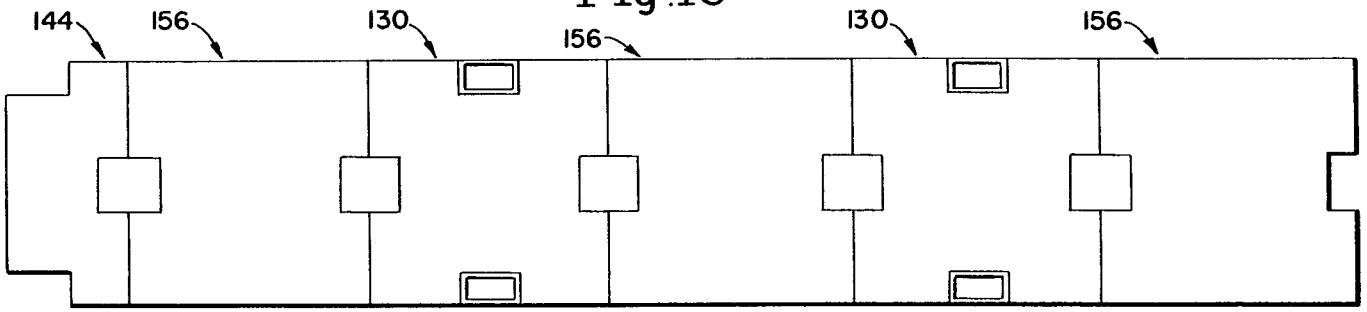
Figure 18:
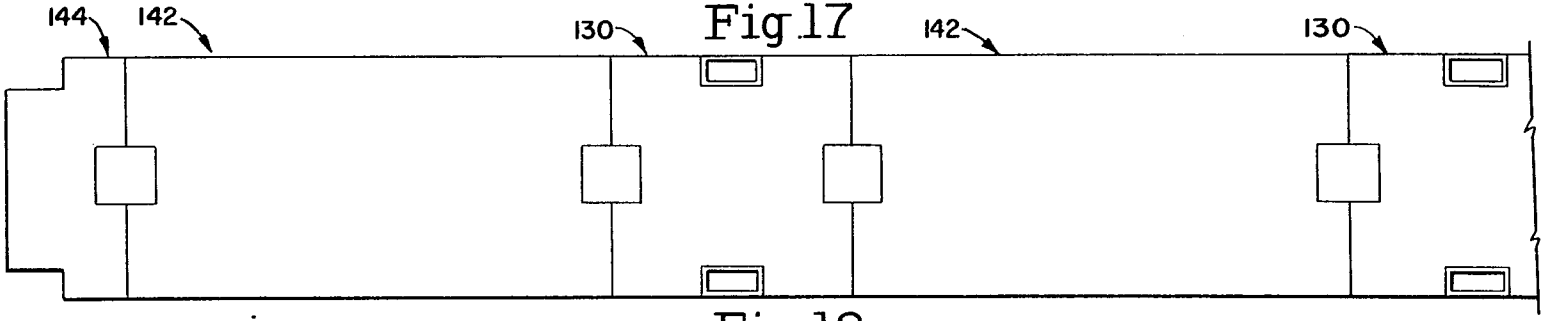
Figure 19:
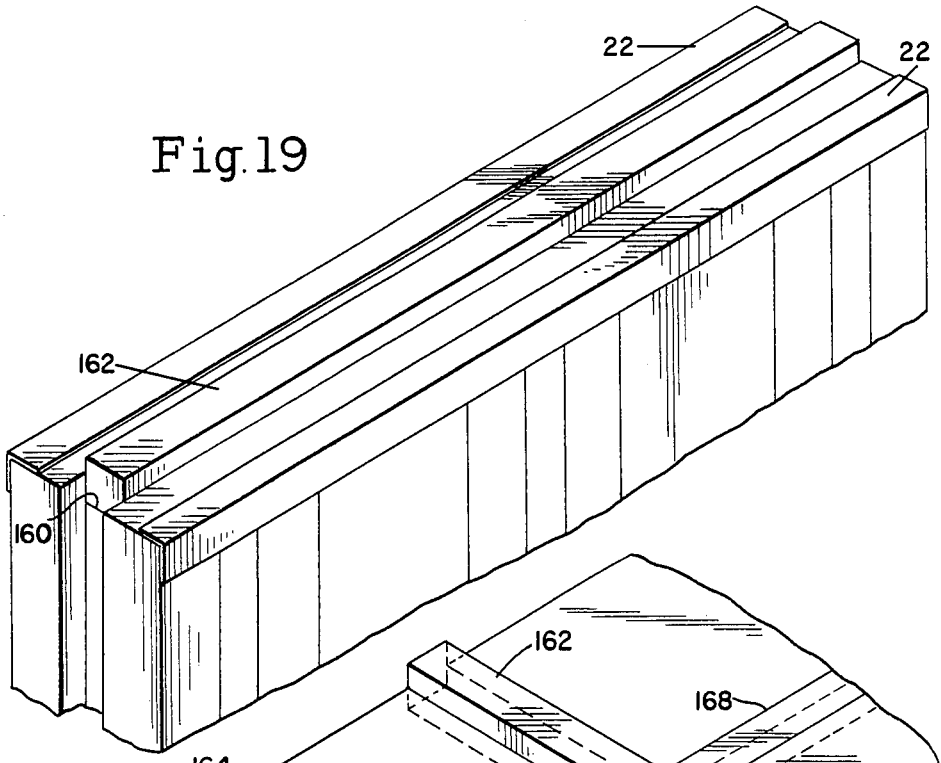
Figure 20:
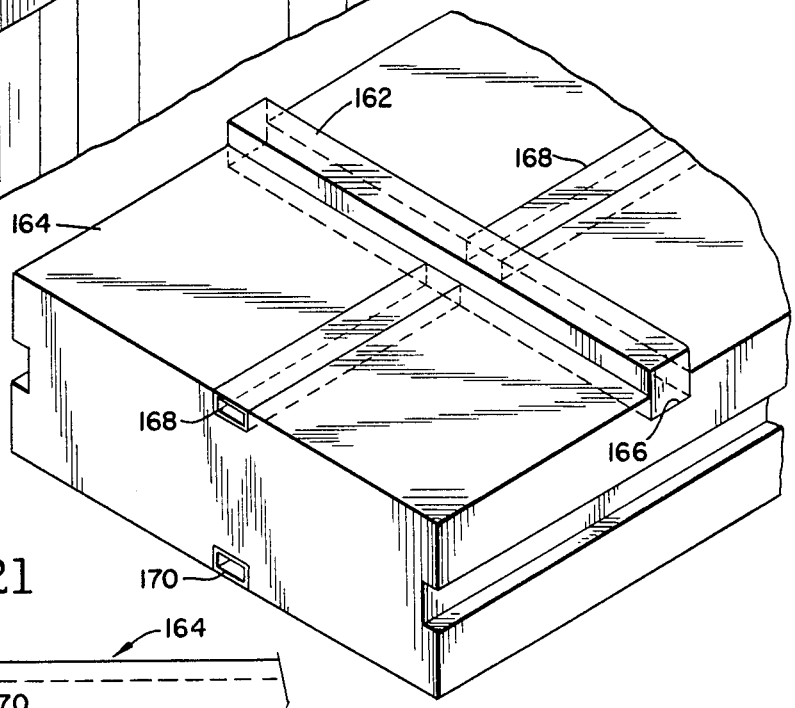
Figure 21:
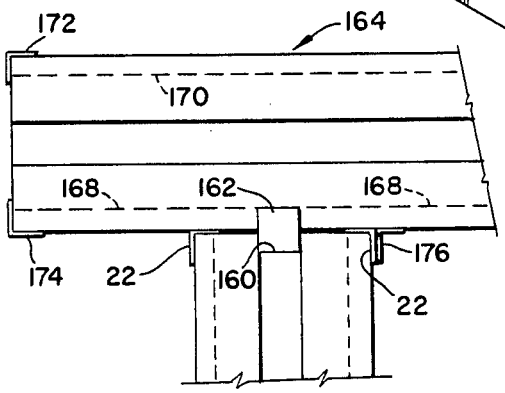
Figures 22, 23:
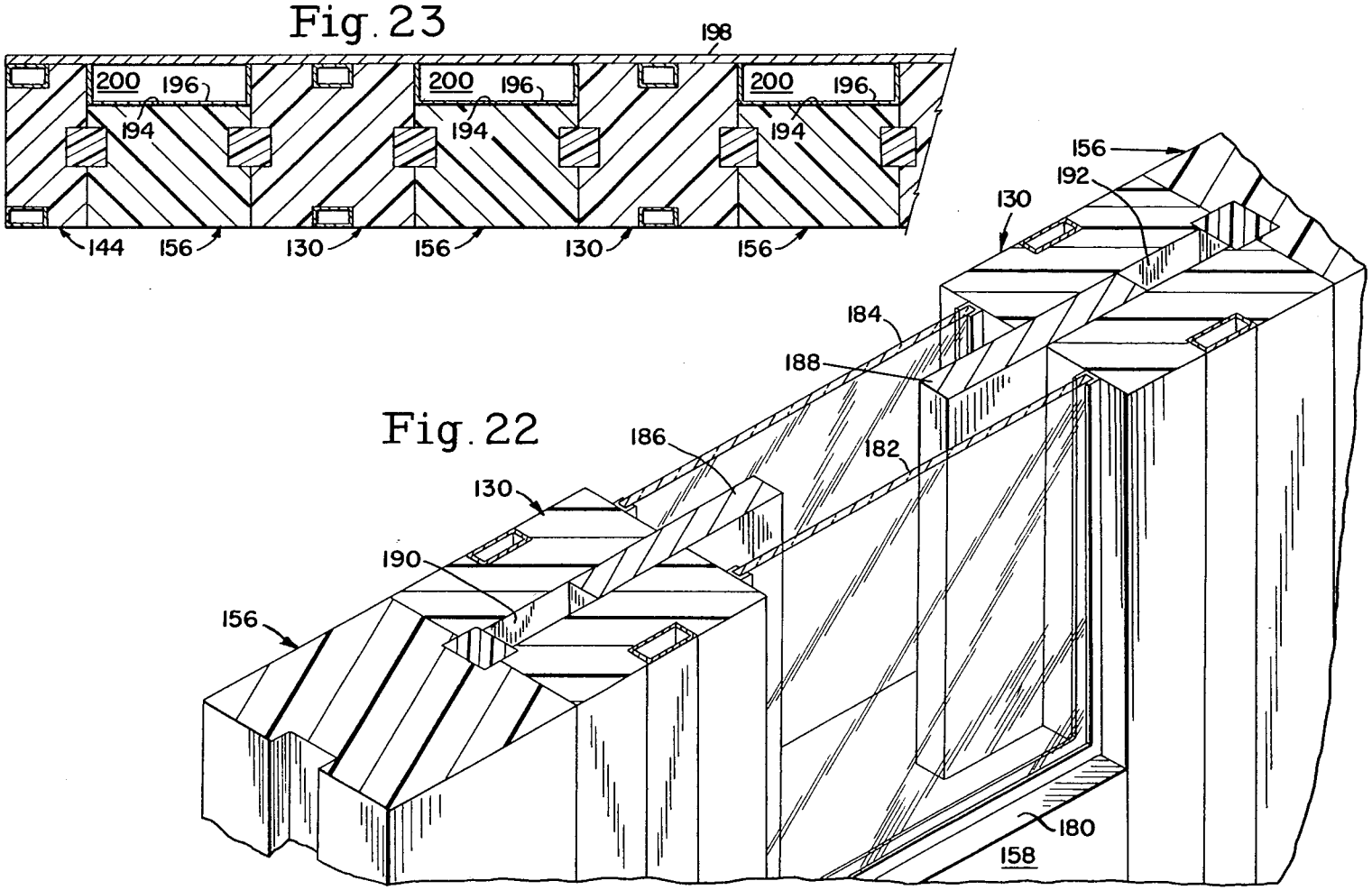

FIGS. 15A and 15B are transverse sections through two basic infill modular foam units;

FIGS. 16 through 18 are transverse sections through typical wall sectwons constructed from various combinations of the basic modular units illustrated in FIGS. 13 through 15;

FIG. 19 is a perspective view of a top portion of a typical wall construction;

FIG. 20 is a perspective view illustrating the under surface of a roof panel;

FIG. 21 is a fragmentary vertical section illustrating the installation of a roof panel of FIG. 22 on the wall construction of FIG. 21;

FIG. 22 is a fragmentary perspective view of a portion of a wall incorporating a window equipped with solar blinds; and FIG. 23 is a transverse section illustrating a modified wall construction incorporating a passive solar heat system.

Figure 1:
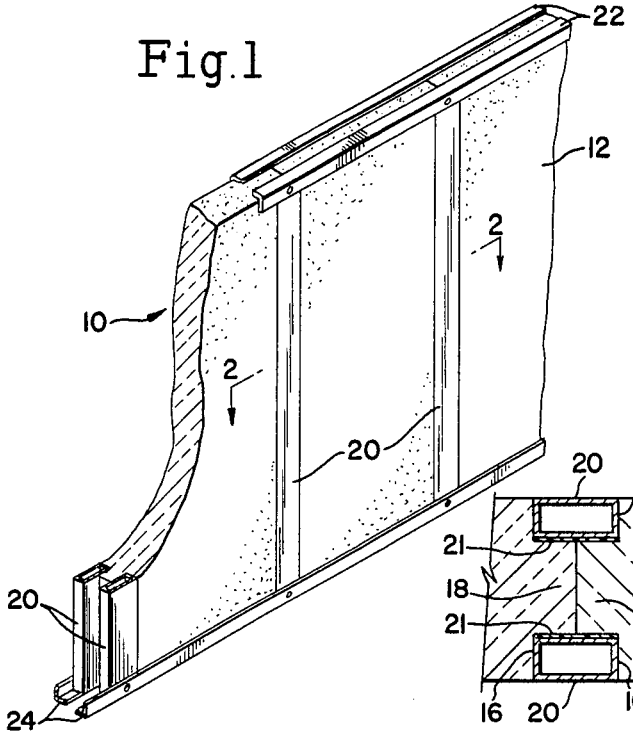
FIG. 1 is a perspective view of a building panel structure made in accordance with the principles of the present invention.
Figure 2:
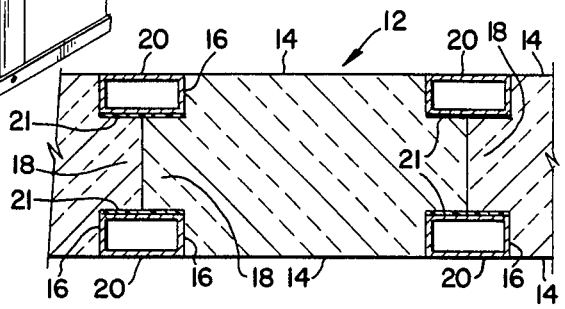
FIG. 2 is a section view taken along line 2—2 in FIG. 1 and looking in of the arrows.

With reference now to the drawings, FIGS. 1 and 2 illustrate a building panel structure 10 in accordance with the principles of the present invention, which basic form of panel construction, with minor variations, may serve as the side walls, roof, interior partitions and, if desired, the floor of a building structure.

As best seen in FIGS. 1 and 2, the panel structure 10 comprises a plurality of elongated slabs 12 of rigid structural grade polystyrene foam insulating material. Each slab 12 includes an opposing pair of major surfaces 14 with a pair of recesses 16 being disposed along each of the longitudinal side edges of each slab 12 to define a tongue portion 18 extending therealong. As best seen in FIG. 2, each such tongue portion 18 projects outwardly from a mid-thickness region of the slab. The slabs 12 are disposed in side-by-side co-planar relationship with the tongues 18 of the respective slabs being disposed in opposed abutting relationship. The adjacent recesses 16 together define opposed grooves located at the junctions between the slabs 12. A rigid framing member 20 is disposed in each of these grooves with the opposing pairs of framing members 20 serving to sandwich the abutting tongues 18 of adjacent slabs 12 there between. A layer 21 of suitable adhesive material serves to secure each framing member 20 of the opposed pair of members to the tongue 18 of insulating material which is sandwiched there between. The tongues 18 of polystyrene foam material serve to provide a thermal break or barrier between the framing members 20.

With further reference to FIG. 2 it will be noted that each framing member 20 comprises a hollow tubular member of rectangular cross-section. Each framing member 20 is of steel preferably galvanized thereby to resist corrosion. Where maximum strength is required the members 20 are preferably of welded construction. For reasons of economy, the members 20 may be roll formed. The roll formed members may be used where the strength requirements are less stringent or may be used throughout if made of increased gauge. It will be further noted from FIG. 2 that that surface of each framing member 20 which is directed outwardly of the panel is generally flush with the associated major surfaces 14 of the slabs of polystyrene associated therewith.

As best seen in FIG. 1, each of the opposing ends of the panel structure 10 has a pair of rigid perimeter framing strips extending there along. The respective pairs of perimeter framing strips are designated by reference numbers 22 and 24 in FIG. 1. In the embodiment of FIG. 1 these perimeter framing strips take the form of galvanized steel angle members. It will be noted that they are spaced apart in the direction of the thickness dimension of panel 10 thereby to provide a thermal break there between. These pairs of perimeter framing strips 22, 24 are also adhesively bonded to the polystyrene foam slabs. It will also be noted that the opposing ends of the framing members 20 are connected to associated ones of the pairs 22, 24 of perimeter framing strips so as to maintain the thermal break. The connection between the perimeter framing strips 22, 24 and the associated framing members 20 may be made by any suitable means such as by spot welding, riveting, or by self-threading screws etc.

The structural properties of rigid polystyrene insulation material are well known, The Dow Chemical Company for example, manufactures a wide variety of polystyrene foams suitable for use in building construction. Since the foam material will be subject to a certain degree of shear stress, especially at the interface between the foam and the framing members 20, particularly when the panel as a whole is subject to bending stresses as, for example, when such panels are used to form the roof sections of the building, the polystyrene foam should exhibit a substantial degree of shear strength depending of course on snow loadings, roof design, etc. Numerous foams are available commercially which have a shear strength of about 17–20 psi for one pound density and 24–30 psi for 1.5 density and which have a thermal resistance R of at least 3.85 and preferably 4.00 per one inch of thickness when measured in hours/square foot/degrees Fahrenheit/BTU. This material will usually have a compressive strength of about 9–13 psi for one pound density and 16–22 psi for 1.5 pound density and a tensile strength of about 20–30 psi for one pound density and 21–40 psi for 1.5 pound density. The average shear modulus will be in the order of 300–350 psi for one pound density and 430–535 psi for 1.5 pound density. (ASTM-C-273-53).

Numerous adhesives are commercially available for bonding the polystyrene foam to the metal framing members. One highly suitable adhesive is known as "FLINTSTIK" (registered trademark) No. 230-21 made by the Flintkote Company of Canada Limited. This adhesive is a solvent type synthetic rubber based insulation adhesive. This material sets rapidly to give a strong resilient bond, the strength of which will exceed the shear strength of the polystyrene foam. The adhesive material should be applied to substantially the full length of each framing member thereby to provide an adequate bonding area between the metal and the foam.

The above basic panel construction, with minor modifications, may be used to form the walls, roof, internal partitions and, optionally the floor of a building structure.

Although not illustrated in FIGS. 1 and 2, the opposing major surfaces of the panel 10 may be coated with a skin of glass fiber reinforced synthetic resin thereby to protect the polystyrene foam from structural damage and to provide added strength to the structure. Preferably, the opposing surfaces of the panel are covered with a variety of skins, such as plywood, sheet rock or cementitious stucco-like material or glass reinforced acrylic resin coating having a thickness from about 3/16 inch to about ½ inches.

Figure 3:
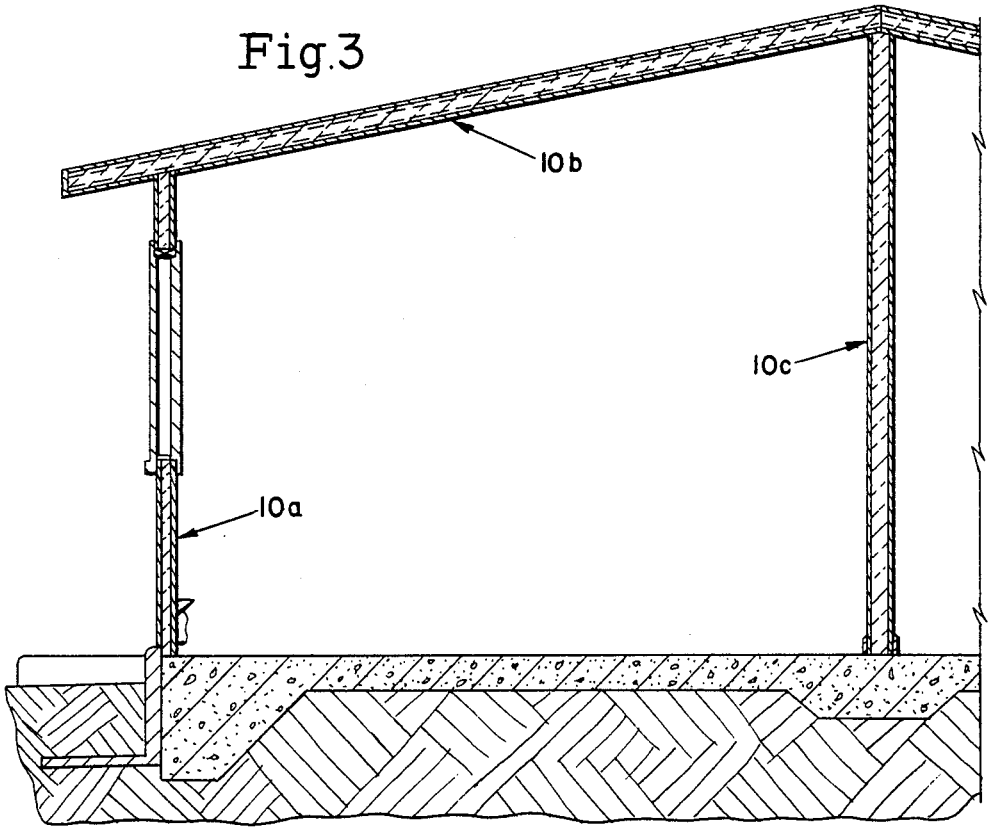
FIG. 3 is a section view taken through a portion of a building constructed in accordance with the principles of the present invention.

A typical building structure in accordance with the principles of the invention is illustrated in FIG. 3 with further details of such structure being shown in FIGS. 4A–4F, FIG. 5, and FIGS. 6A–6C.

With reference to FIG. 3, it will be seen that the building structure includes exterior load bearing wall panels **10*a*, roof panels 10*b*, and interior load bearing panels 10c. The end walls of the building are not shown in FIG. 3** nor are any additional interior partitions shown.

Figure 4:
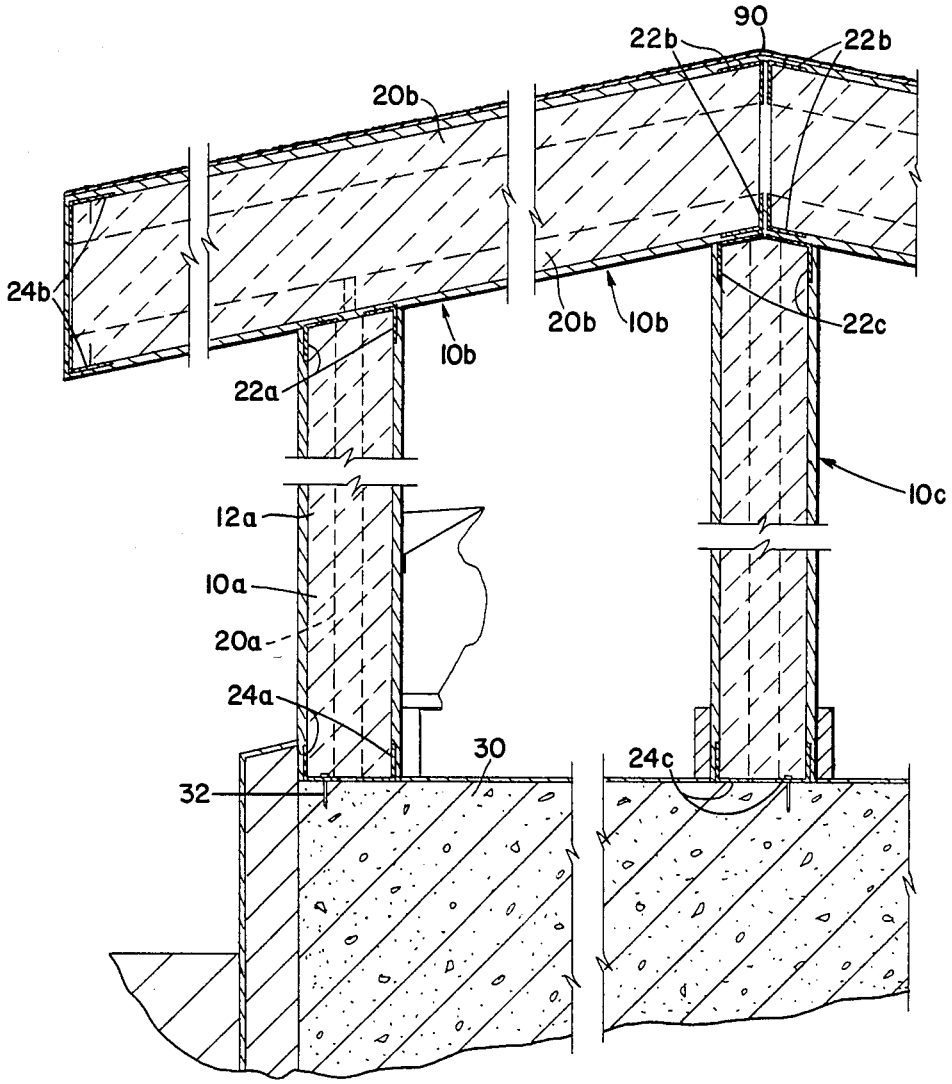
FIG. 4 is an enlarged fragmentary cross-section illustrating details of the building structure illustrated in FIG. 3.

With further reference to FIG. 4 it will be seen that the exterior load bearing wall panel 10a includes polystyrene foam slabs 12a as described previously in relation to FIGS. 1 and 2 and is provided with vertically spaced pairs of tubular framing members 20a. The upper edge of exterior wall panel 10a is provided with a cap comprising spaced apart perimeter framing strips 22a while the lower edge of exterior wall panel 10a is provided with a sill comprising a similar pair of framing strips 24a. The outermost framing strip 24a is connected to the concrete slab floor 30 by means of a series of spaced apart pins or "RAMSET" (registered trademark) fasteners. These fasteners are illustrated by reference number 32. The upper peripheral framing strips 22a defining the cap are angled to match the slope of the roof panel 10b. The interior and exterior of wall panel 10a may be covered with a glass reinforced acrylic resin coating 3/16 inch to ½ inches thick. The exterior surface of wall panel 10a is also provided with any additional suitable decorative surface such as a decorative stucco manufactured by the Flintkote Company of Canada Limited. This stucco which is preferred is a polymer fortified cement based product which is mixed with water before use. Any other suitable form of decorative exterior finish may be used. The interior surface of wall panel 10a may likewise be covered with any suitable building material as, for example, fiberboard, wall panelling, plasterboard, etc.

In a typical embodiment of the invention, the wall panels 10a utilize 4" thick polystyrene foam insulation with the framing members comprising pairs of 1" by 2" by 18 gauge steel galvanized tubes located at 24" centers. The pre cut 4" thick polystyrene slabs were provided with tongues having a thickness of about 2" between the opposing tubular framing members 20a. The cap and sill peripheral framing strips 22a and 24a respectively consisted of pairs of 1⅜"×1⅜"×18 guage steel angles running continuously and screwed to the tubular steel framing members 20a. The exterior sill peripheral framing strip 24a was connected to the concrete foundation base using ⅛" steel drive pins located at 12" centers.

The roof panels 10b are of similar construction to the wall panels 10a except that they are usually made somewhat thicker thereby to provide additional bending strength. In a typical embodiment designed for a maximum deflection of L/240, the slabs of polystyrene foam had a thickness of 6". Both major surfaces of the roof panels were coated with a glass reinforced acrylic resin coating in the same fashion as for the wall panels. In addition, the exterior surface of the roof panels may be coated with a general purpose heavy duty protective coating such as "FLINTGUARD" 800-48 reinforced asphalt emulsion roof coating. This product is made by the Flintkote Company of Canada Limited.

With further reference to FIG. 4 it will be seen that the roof panels 10b are provided with a perimeter framing strips 22b and 24b which are similar to those described previously except that the included angles between the flanges of such members are adapted to suit the pitch of the roof. The lowermost set of roof panel framing members 20b are screwed to the cap members 22a by suitable sheet metal screws or the like. Suitable aluminum facing members may be applied to the exposed surfaces of the roof panels in a manner which need not be described further here.

Figure 4A:
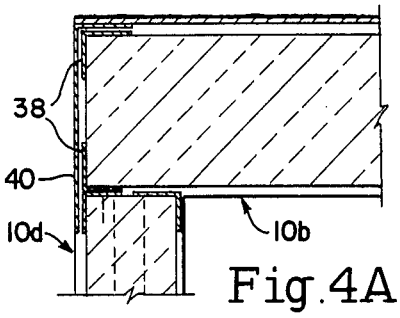
FIG. 4A illustrates, in section, the roof panel to gable end connection.
Figure 4B:
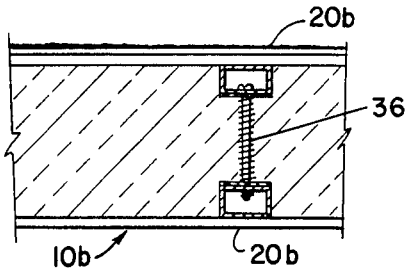
FIG. 4B illustrates, in section, a portion of the roof panel illustrating the metal framing members.
Figure 4C:
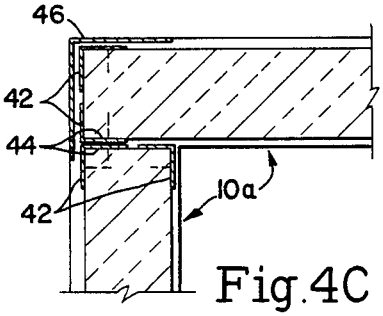
FIG. 4C illustrates, in section, outside wall panels at an outside corner of the building.
Figure 4E:
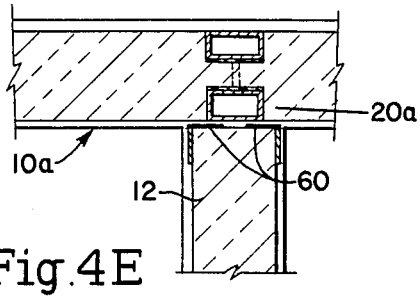
FIG. 4E illustrates, in section, a junction between an outside wall and an interior vertical partition.

With reference to FIGS. 4C and 4E, the interior load bearing panel 10c is constructed and functions in much the same manner as the previously described exterior load bearing wall panel 10a. The upper edge of the interior load bearing panel 10c has a cap defined by a pair of perimeter framing strips 22c shaped to match the oppositely directed slopes of the roof panels 10b while the lower edge of wall panel 10c is provided with a sill defined by perimeter framing strips 24c connected to the concrete base by suitably located drive pins. The opposite major surfaces of wall panel 10c are preferably provided with the above mentioned glass fiber reinforced acrylic resin coating together with such interior surfaces as may be desired.

With reference to FIGS. 4A and 4B, the roof panel 10b is shown in transverse cross section, FIG. 4B illustrating the framing tubes 20b in cross section. In certain applications it is desirable to interconnect the opposing pairs of tubes 20b together, as for example, by three or four spaced apart sheet metal screws the latter being designated by reference numeral 36. These interconnecting screws may be used to hold the framing members securely in place while the adhesive material is setting. Similar interconnecting screws may be used in the various wall members as well. FIG. 4A illustrates the edges of roof panel 10b as resting on a building end wall panel 10d. It will be noted that the longitudinal side edges of the polystyrene slabs of the roof panels located adjacent the ends of the building are formed somewhat differently from the longitudinal side edges of the intermediate slabs in that the tubular framing members are not required but, rather, longitudinally extending frame angle members 38 are provided to impart the necessary structural strength and rigidity. Suitable metal cladding or fascia elements 40 are also shown in FIG. 4A to protect the polystyrene and also provide an attractive appearance.

FIG. 4C illustrates one manner of interconnecting an outside wall panel 10a to a further outside wall panel 10a at the corner of the building. In this particular embodiment, the polystyrene foam slabs next adjacent the outside corner of the building are not provided with recesses and tubular seal framing members as described previously but, rather, are provided with pairs of vertically disposed steel angle members 42 bonded by adhesive to the foam core material. The corner is made secure by a series of fastener elements 44 serving to interconnect together the adjacent angle members 42. In addition, a vertically disposed metal corner cover 46 is provided which extends fully around the corner and is connected to the associated angle members 42 thus further reinforcing the joint at the outside corner.

Figure 4D:
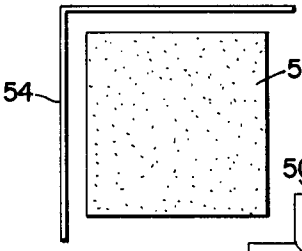
FIG. 4D illustrates a modified form of outside corner construction.

An alternative form of corner connection is shown in FIG. 4D. In this particular embodiment, the polystyrene foam panels 12a adjacent the corner are provided with the previously described spaced apart pairs of tubular framing members 20a. An upright steel angle member 50 is disposed in the recess defined by the adjacent ends of the two panel members 12a and such angle member serves to interconnect together the two closely adjacent upright framing members 20a. An elongated insulating block of polystyrene 52 is then set into the recess defined by the adjacent ends of the panels and is secured in place by adhesive. An external metal angle cover member 54 is applied over the entire assembly and serves to protect the insulating block 52 from damage.

One method of connecting an interior panel 10*c* to an exterior wall panel 10*a* is illustrated in FIG. 4E. In this embodiment, the polystyrene foam panels 12*c* most closely adjacent the exterior wall are provided with vertically disposed steel angle framing elements 60. These framing elements are attached via sheet metal screws to an associated tubular framing element 20*a* of the exterior wall 10*a*.

Figure 4F:
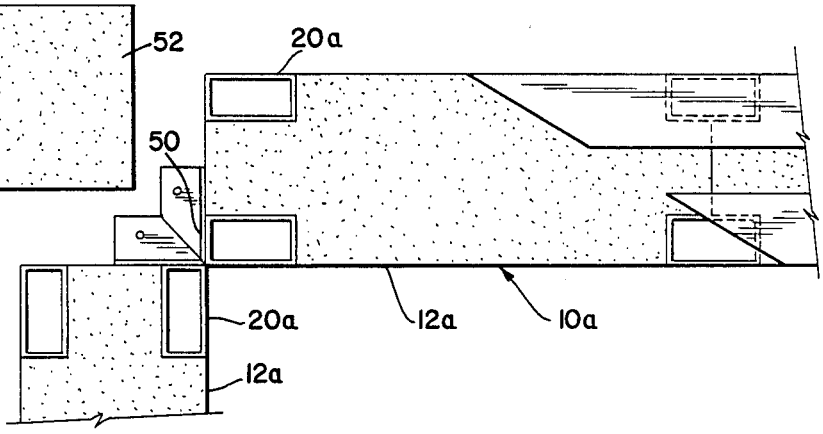
FIG. 4F is similar to FIG. 4E and illustrates a somewhat modified form of outside wall to interior panel connection.
Figure 4F:
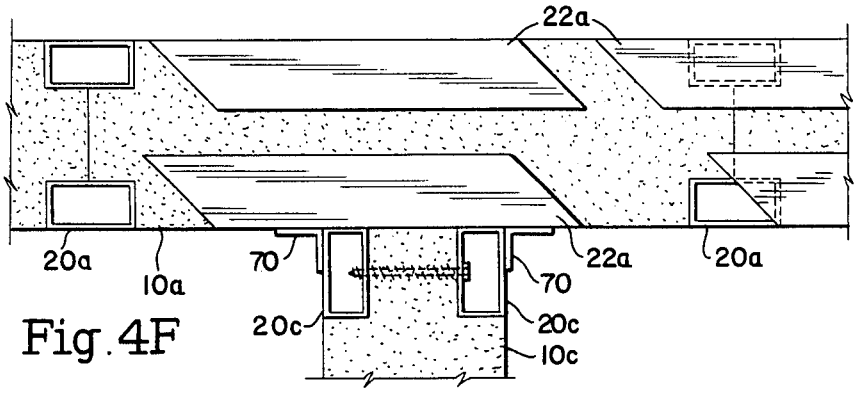

FIG. 4F illustrates an alternative form of connection between the interior wall panel 10*c* and exterior wall panels 10*a*. In this arrangement, the polystyrene foam panel most closely adjacent the exterior wall is provided with the previously described tubular framing members 20*c*. This arrangement is used when the interior wall panel 10*c* comes into abutting relation with the outer wall panels 10*a* at a location intermediate the spaced apart pairs of tubular framing members 20*a* of the outer wall panel. In the arrangement shown in FIG. 4F, the tubular framing members 20*c* are each provided with upper and lower angle connector elements 70 which are connected to respectively associated ones of the associated cap and sill framing strips 22*a* and 24*a* of the outer wall. It is also noted here that if required a strap may be fastened from members 20*a* to additional angle members 70 connected to framing members 20*c* to provide intermediate support connections at elevations other than the top and bottom of the wall panels 10*a* and 10*c*.

Figure 5:
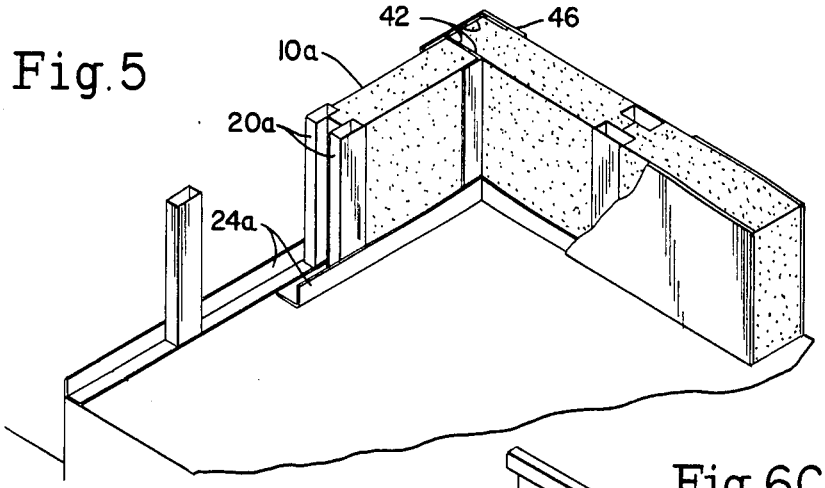
FIG. 5 is a perspective view of typical outside wall panel configuration secured to a suitable base.

The perspective view of FIG. 5 merely serves to further illustrate and clarify the outside corner construction illustrated previously particularly with reference to FIG. 4C.

Figure 6A:
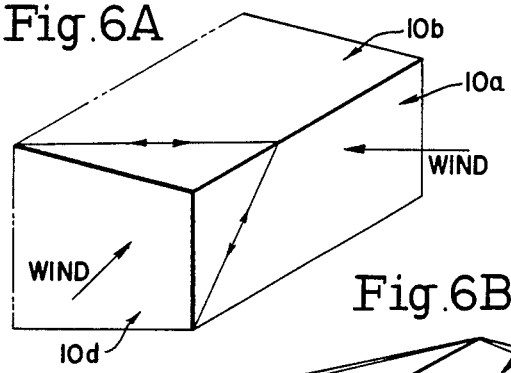
FIGS. 6A and 6B are diagrammatic views illustrating the application of tension braces to certain of the structural panels of the building.
Figure 6C:
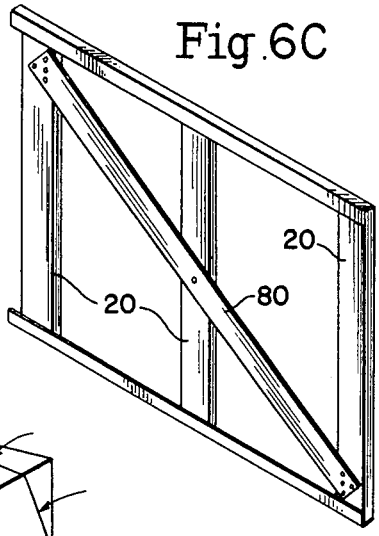
FIG. 6C illustrates a portion of a panel frame construcdton including a diagonal tension brace thereon.
Figure 6B:
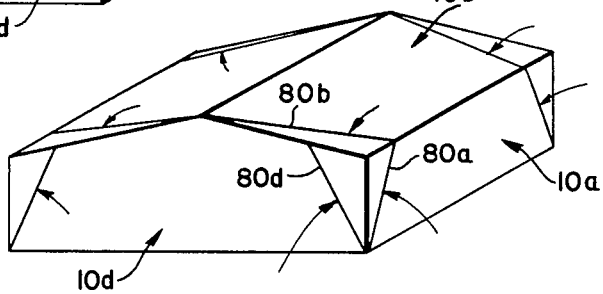

FIGS. 6A–6C illustrate the application of tension braces 80*a*, 80*b*, and 80*d* to the outer wall panels 10*a*, the roof panels 10*b*, and the building end wall panels 10*d* respectively. It will be seen particularly from FIG. 6B that these bracing straps are provided in each of the panels noted above adjacent the four corners of the building. These tension braces take the form of diagonal steel straps 80 as illustrated in FIG. 6C. The steel straps provide lateral stability against wind and earthquake loads. By using the tension braces 80, the roof panels 10*b* acting as braced diaphragms, transfer lateral loadings to adjacent braced wall panels 10*a* and 10*d* which, in turn, transfer the load to the foundation. As best seen in FIG. 6C the tension braces 80 are connected to the exteriorly disposed hollow tubular framing members 20 in the roof and wall panels adjacent the building corners as described with reference to FIG. 6B.

Figure 7:
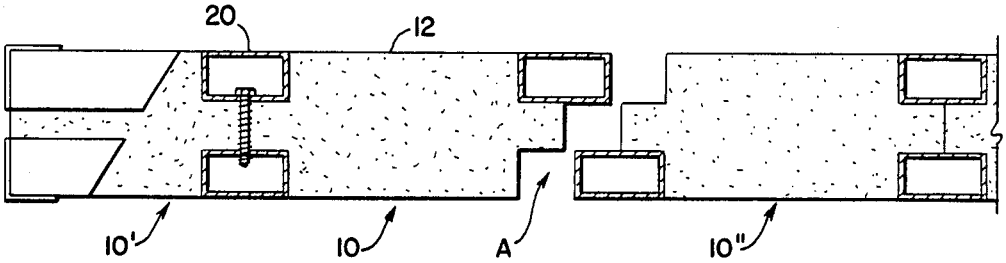
FIG. 7 is partial cross-sectional view of a building panel structure illustrating the manner in which such panels may be partially pre-fabricated and shipped in a partially assembled manner.
Figure 8:
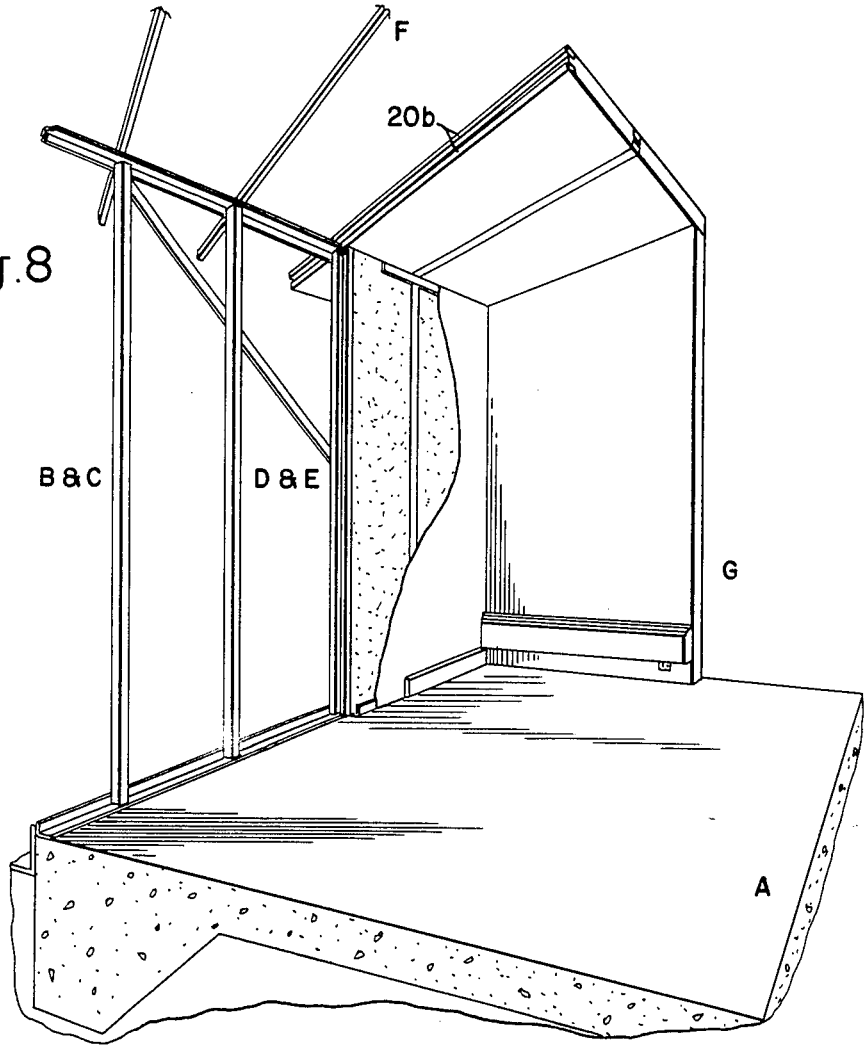
FIG. 8 is a perspective view of a portion of the building structure which will assist in understanding the construction erection sequence.

Although building panels according to the present invention are particularly well suited for on site construction, it is possible to wholly or partially prefabricate certain of the panel constructions. FIG. 7 shows a typical view of a partially prefabricated panel 10; in order to complete the construction on site the panel section 10' may readily be connected to the panel section 10'' by adhesively bonding the two panel sections together in the region broadly indicated by arrow A and then applying the usual perimeter framing angles.

The erection of a building structure in accordance with the invention will now be described with reference to Fig.8 and FIGS. 9A–9G.

The first step is a fairly conventional one involving the preparation of the necessary grades and the installation of any under floor services followed by the placing of concrete forms and the pouring of a reinforced concrete foundation and floor slab. Following this, the concrete is allowed to cure.

Figure 10A:
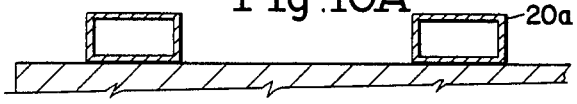
Figure 10C:
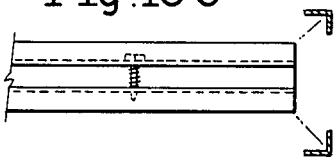
Figure 10B:
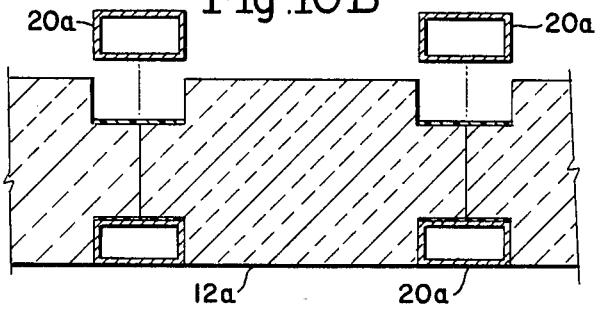
Figure 10D:
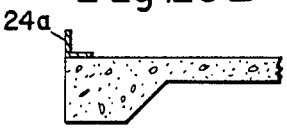

A straight line is then established along the long side of the floor slab. The inside tubular framing members 20*a* are then positioned perpendicular to the straight line at the predetermined intervals, reference being had to FIG. 10A. The adhesive material is then applied to framing members 20*a* and the polystyrene slabs 12*a* are positioned on top of the framing members 20*a*, reference being had to FIG. 10B. Adhesive is then applied into the grooves of the polystyrene slabs 12*a* and the second set of tubular framing members 20*a* is positioned in such grooves. Adhesive is then applied to the perimeter framing strips 22*a* and the same are positioned along the top perimeter of the aligned polystyrene slabs 12*a*. These perimeter framing strips 22*a* are then fastened to their associated framing members 20*a* with self-drilling screws, spot welding or other suitable fastening means. If required at this time, intermediate fasteners e.g. self-tapping may be inserted into the opposed pairs of tubular framing members 20*a* to secure same together, reference being had to FIG. 10C. Insofar as the perimeter framing strips 24*a* forming the sill for the wall panel are concerned, only the inside perimeter framing strip 24*a* is attached to members 20*a* at this time. The outside perimeter framing member 24*a* forming a part of the sill is fastened to the concrete base using steel drive pins as described previously. This is illustrated in FIG. 10D.

It should also be noted here that the necessary openings for doors and windows are provided in the desired locations preferably using tubular steel members for top headers in the various openings. These tubular steel members may be spot welded to associated ones of the upright framing members 20*a* as required. The casings for the doors and windows may be constructed in basically conventional fashion. Also, at this time, the diagonal tension braces 80 are applied to the outside tubular framing members 20*a* and secured thereto by spot welding, self-tapping screws or the like as illustrated previously in FIG. 6C.

Figure 9A:
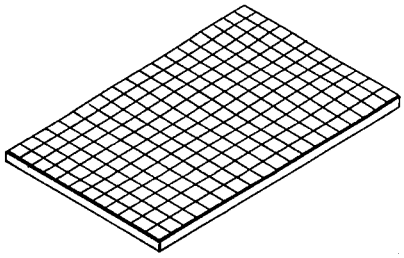
FIGS. 9A through 9G are diagrams illustrating the sequence of construction of a building system in accordance with the present invention.
Figure 9B:
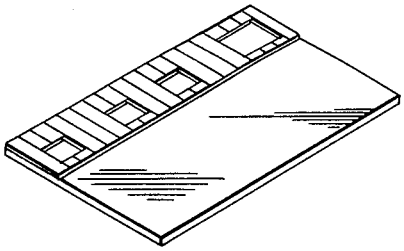
Figure 9C:
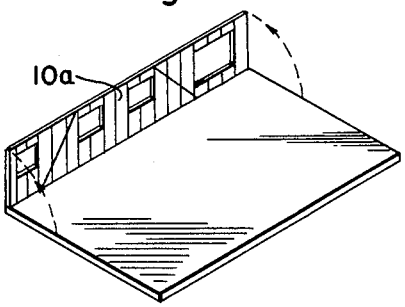
Figure 9D:
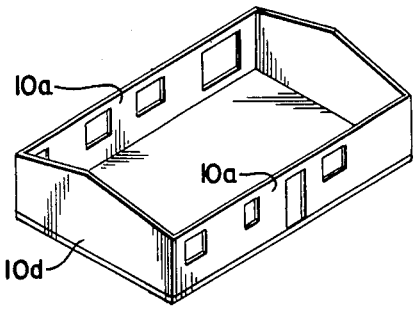
Figure 9E:
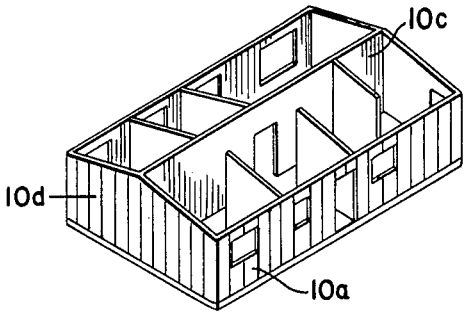
Figure 9F:
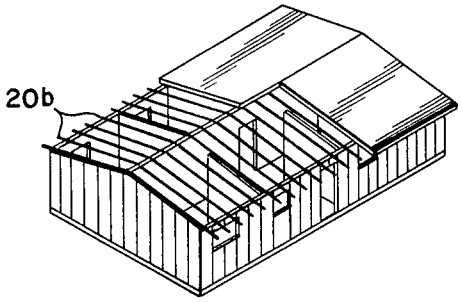

With reference to FIG. 9C, the entire wall panel 10*a* is then tilted 90° into an upright position and temporarily braced and then secured to the concrete floor slab by attaching the outside tubular members 20*a* to the exterior perimeter framing strip 24*a*, the latter having been previously attached to the concrete base.

The opposing long wall is then constructed and erected using the same procedure as outlined above. Following this, the end wall panels 10*d* of the building are constucted and erected as outlined previously.

The various walls are dimensioned so that their inside edges meet as illustrated in FIG. 4D thus enabling the walls to be fastened together with the previously described angle member 50 following which the insulating block 52 is positioned in place and the corner cap 54 applied.

The central load bearing wall panel 10*c* is then constructed and swung upwardly into an upright position using essentially the same techniques as outlined previously for the outside walls. Appropriate openings in the center load bearing wall are provided as required.

Assuming that the roof is not prefabricated, the bottom tubular framing members 20*b* are located in parallel relationship at the required spaced intervals and connected to the perimeter framing strips 22*a* and 22*c* of the outer and central load bearing walls respectively. The connection may be made using self-drilling screws, spot welding or other suitable fasteners.

The adhesive material is applied to the tubular framing members 20b and subsequently the polystyrene foam slabs 12b are positioned on top of them in a similar fashion as described previously in connection with the exterior walls. Then the adhesive material is applied to either the top framing members 20b or the polystyrene foam slabs and then these steel members are positioned on the polystyrene foam slabs within the grooves located at the junctions between the respective slabs. At this time intermediate fastener members may be applied to more firmly secure the opposing pairs of tubular framing members 20b together.

If the roof panels have been previously prefabricated it is a simple matter to place same on top of the load bearing wall panels 10a and 10c and to fasten the lower framing members thereof to the perimeter framing strips 22a and 22c as described previously.

Following the above, the diagonal tension braces 80b are applied as described previously in connection with FIGS. 6A–6C. Following this, a suitable metal cap member 90, as illustrated in FIG. 4 may be applied along the ridge with suitable fasteners.

At this point, there may be constructed and erected any remaining interior partitions using essentially the same methods as described previously. The structure is now ready for interior and exterior surface applications. One may use a variety of structural or non-structural facings such as plywood, sheet rock or cementitious stucco-like material.

Figure 9G:
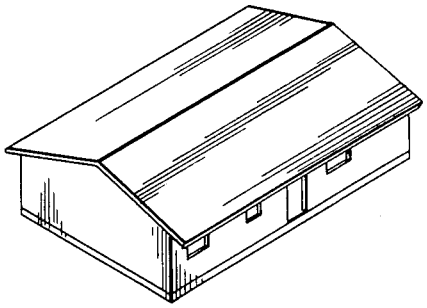

The final stages with reference to FIG. 9G include installing windows and exterior doors. The exterior finish coatings are applied as well as the roofing materials. The electrical wiring is installed, it being noted here that electrical distribution is preferably provided by means of a surface metal raceway system installed around the perimeter of the house at the base of the walls or in the walls themselves if required. Heating may be accomplished by means of electrical baseboard systems, floor registers, or thin air ducts which may be located in double walls, or in the walls themselves, if required.

The embodiments of the invention illustrated in FIGS. 11 and 12, now to be described, incorporate composite steel foam basic components, the characteristics and advantages of which are similar to those of the previously described embodiments. However, they have the additional advantage of providing increased flexibility of design, permitting more precise tailoring of the desired load bearing characteristics to the requirements of a particular building, and effecting certain additional economies in manufacture and assemble.

Referring now more particularly to FIG. 11 the basic building component comprises a slab or panel 100 of structural foam as previously described having major surfaces 102 and 104 recessed to receive opposed pairs of tubular steel members 106 and 108. As in the previously described embodiments the steel members are bonded or chemically welded to the foam panel 100 by an adhesive which provides a bond the strength of which exceeds the shear strength of the foam material to assure the desired coaction between the steel and foam members.

Since the steel members 106 and 108 are disposed wholly within the panel 100 they may be installed and bonded in place at a factory on a production line basis with certain economies as compared with the previously described embodiments which require on site installation of these members.

While in the embodiment FIG. 11 two opposed pairs of steel members are illustrated it will be understood that, where required, additional pairs of such opposed steel members may be incorporated in the foam panels. In this embodiment of the invention adjacent panels are joined together and held in assembled relation by a spline 110 received in recesses appropriately formed centrally of the side edges of the panels. Preferably the splines 110 are formed of structural foam although other materials may be used where desired.

It has been discovered that, where foam of higher density is used, greater loads can be carried by that section of the foam panel that works in conjunction with the steel tubes. It has also been discovered that the portion of the total panel which acts as part of the load carrying member is limited to a relatively small proportion of the total panel adjacent to the steel members. The embodiment of FIG. 12 takes advantage of these factors.

In this embodiment of the invention the main panels 112 may be of the same form as the panels 100 and may, as illustrated, omit the pairs of reinforcing tubes 106 and 108. Interposed between adjacent ends of the panels 112 are shorter panels or posts 114 which are recessed to accommodate opposed pairs of a tubular steel members 118 which are bonded in place as in the previously described embodiments.

The other surfaces of the posts 114 are recessed to accommodate splines 120 which serve to join the panels 112 to the posts 114 and hold them in assembled relationship. As before the splines may be of structural foam or other suitable materials as required.

In a typical example of the embodiment of FIG. 12 the posts 114 will be of considerably higher density than the panel 112. For example, if the panels 112 have a density of one pound/cubic foot the posts 114 may have a density as high as five pounds per cubic foot. In view of the substantial cost differential between the high density and low density foam the embodiment of FIG. 12 permits substantial savings in the utilization of relatively small sections of high density foam where it is needed and the use of lower density less expensive foam in regions where the load bearing requirements are less stringent. The use of a few panel and post sizes in different combinations provides for much dimensional flexibility in design.

The advantage of varying the density of the foam as opposed to varying the gauge of the steel members is due to the fact that the strength of the panel in composite is dependent on the bond between the steel and the structural foam and the strength of the structural foam adjacent to the bond.

It has been discovered that the system lends itself particularly well to modular construction through the utilization of a minimum number of standard prefabricated components. By employing these standard components in a variety of configurations the variable strength, stiffness and load bearing requirements may be met while maintaining the steel framing members or studs on 16" or 24" centers to permit the installation of standard interior and exterior finishing panels which have a standard width of 48".

The same number of components of the same configuration may be dimensioned to provide the same advantages when used in a metric system.

In all cases the recesses provided for the reinforcing tubes may take other forms, i.e. they may be halfrounds, V-shaped, elliptical or of other shapes to accommodate correspondingly configured tubes.

The basic modular units and typical wall structures combining these units in differing configurations are illustrated in FIGS. 13–20 now to be described.

FIG. 13A illustrates a structural foam member 8" in width and having a thickness $T_2$ which typically varies from 4" to 12". The unit is formed with opposed recesses 132 and 134 for the reception of adhesively bonded metal reinforcing tubes as described above and opposed recesses 136 and 138 for the reception of connecting splines as also described above. The units 140 and 142 of FIGS. 13B and 13C are the same as the unit of 130 of FIG. 13A except that the unit 140 has a width of 16" and the unit 142 has a width of 24".

FIG. 14 illustrates three basic structural foam units utilized as end pieces in a wall or roof panel. The unit 144 has a width of 4" and a thickness $T_2$ which corresponds to the same dimension in the units of FIG. 13. On one face the unit has a recess 146 for the reception of a connecting spline and on its opposite face a pair of recesses 148 and 150 for the reception of the reinforcing tubes. The units 152 and 154 of FIG. 14B and 14C are the same as the unit 144 except that the unit 152 has a width of 8" and the unit 154 has a width of 12".

FIG. 15 illustrates structural foam units which are utilized as infill members where the reinforcing posts are not required. Thus the unit 156 of FIG. 15A is identical to the unit 130 except for the omission of recesses 132 and 134. Similarly the unit 158 of FIG. 15B is identical to the unit 140 except for the omission of these same recesses.

FIG. 16 illustrates a typical assembly of the units into a wall structure where variable load carrying capacity is required. As illustrated, the left hand portion of FIG. 16 includes an end piece 152 and a basic panel 140 to provide a wall structure having a typical load bearing capacity of 1600 pounds per linear foot. The central section of FIG. 16 of the wall unit of FIG. 16 comprises the basic units 130 to provide a wall region having a load bearing capacity typically of some 3000 pounds per linear foot. If desired, the remaining portion of the wall may duplicate the portion shown at the left or may utilize other components. It will be noted that the steel reinforcement posts appear on 16" centers to permit the installation of standard 48" wide interior and exterior finishing panels.

If the strength requirements of the wall are uniform a wall can be constructed entirely of the units 140 or 142.

FIG. 17 illustrates a wall section comprising end piece 144 and alternate units 156 and 130. A configuration of this type may be utilized where the load requirements do not require the presence of steel reinforcing tubes in each of the members. Again the reinforcing posts are located at 16" centers.

FIG. 18 illustrates the wall section comprising end piece 144 and alternate units 142 and 130, an arrangement which disposes the reinforcing posts on 24" centers.

FIGS. 19, 20 and 21 illustrate an alternate and presently preferred roof panel construction and the connection between the roof panel and the vertical walls.

As in the embodiment of FIG. 1 galvanized steel angle perimeter framing strips 22 are installed along the upper edges of the preassembled wall panel. In addition the upper edge of the wall panel is recessed as at 160 to receive a horizontal spline member 162 typically a 2" by 2" structural foam member. A typical roof panel shown inverted in FIG. 20 may take the form of any of the wall units shown in FIG. 13. In the illustrated embodiment the panel 164 is of the same form as the unit 140 of FIG. 13B. To adapt it for use in a roof panel it is transversely recessed as at 166 to receive the connecting spline 162 and the steel reinforcing tube 168 is correspondingly interrupted to permit the installation of the spline. The opposing reinforcing tube 170 preferably extends the full length of the panel.

The roof panel of FIG. 20 is then inverted and installed on top of the wall structure shown in FIG. 19, the completed assembly being shown in FIG. 21. After installation of the desired number of roof panels, corner angles 172 and 174 and connecting clip 176 are installed either adhesively or by using screws or rivets. It is to be particularly noted that the discontinuity and the lower reinforcing tubes 168 preserves the thermal break between the exterior and interior of the structure. The roof may be completed by the installation of any suitable interior and exterior finishing and protective sheets or materials.

Because of the fact that the modular building panels are essentially solid and because of the ease with which their configuration can be altered the building system of the present invention lends itself readily to the inclusion of special features not readily obtainable, or obtainable only at substantial cost in conventional systems.

For example, the windows may be provided with solar blinds as shown schematically in FIG. 22. As there shown the wall comprises a series of panels 156 and 130 and a central panel 158, the latter being cut away as at 180 to provide a window opening, the upper portion of which has been omitted for clarity. Inner and outer glass panels 182 and 184 are installed utilizing conventional techniques. In particularly rigorous climates it is advantageous to close the window openings, particularly during periods of darkness. To this end slidable blinds 186 and 188 are positioned in appropriate recesses 190 and 192 formed in the members 130 at opposite sides of the window. Preferably the panels 186 and 188 are of structural foam material of suitable thickness, typically 1 to 2 inches. The panels are so dimensioned that they may be advanced to fully close the window opening or may be retracted to lie flush with the edges of the window opening. The panels may be moved between their limit positions by any suitable motor drive means, not shown. If desired, light sensitive control apparatus may be provided to automatically close the panels during periods of darkness and open them at all other times.

As shown in FIG. 23 the wall construction previously described may be readily modified provide a solar heat system. For illustrative purposes a portion of the typical wall has been shown comprising an end piece 144 and a series of alternate infill members 156 and reinforced panel members 130. These panel members are as previously described except that the infill members 156 are recessed at 194 to receive liners 196 of plastic or light weight sheet metal. Typically the outer surface of the wall is covered by metal cladding 198, the cladding forming with the liners air spaces 200 preferably extending the full height of the wall.

At their upper and lower ends the air spaces 200 are selectively connected to the interior of the structure. Accordingly, during hours of sunlight the air within the spaces 200 is heated and travels by convection from the region of the floor of the structure toward the region of the ceiling. If desired the flow of air may be increased by small blowers.

In all embodiments of the present invention steel tubes 2"×1", 2"×1.5", or 2"×2" having a gauge from 16 to 19 may be used with satisfactory results. Typically the main panels in all embodiments of the invention will have a density of one or one and a half pounds per cubic foot while the posts such as illustrated in FIG. 12 may be of substantially greater density.

In all embodiments the composite polystyrene steel panel acts as a core for various types of finishes which may be (1) visual or cosmetic or (2) protective or (3) have a capacity to contribute to the structural strength of the panel or any combination of those three.

In all embodiments of the invention the need for elaborate connections between adjacent panels is eliminated thus preserving the surface continuity between the edges of adjacent panels and permitting the convenient application of any suitable facing material Adjacent panels may be held together by extending the top and bottom perimeter strips beyond the edges of the panels, or, where the perimeter strips are co-extensive with the individual panels, the strips themselves may be secured together by any convenient simple means. Further, when sheet type facing materials are applied, such as sheet rock or plywood, the facings can bridge the joint between adjacent panels and thus perform the dual function of holding the panels securely in edge to edge contact and providing excellent cosmetic appearance.

It is a feature of the invention that the load bearing properties and other mechanical characteristics of any combination of steel and structural foam can be determined and tabulated for the use of builders and designers as has been done in the past for more conventional materials such as wood, steel and concrete. For example tables have been developed giving the load carrying capacity of various configurations of the discussed composite structures.

The following tables which are applicable to composite units incorporating welded framing members are illustrative:

TABLE 1

LOAD TABLE FOR 1.0 × 2.0 TUBE
ALLOWABLE AXIAL (DEAD + SNOW) LOADS
ON EXTERIOR WALLS (PLF)
DENSITY = 1.0 PCF WALL THICKNESS = 5 IN WIND LOAD = 5 PSF
VIRGIN YIELD STRENGTH OF STEEL TUBE MATERIAL = 45000 PSI

| | | TUBE GAUGE | | | | | | | |
|---|---|---|---|---|---|---|---|---|---|
| | | 16 | | 17 | | 18 | | 19 | |
| | | TUBE SPACING (IN) | | | | | | | |
| HEIGHT FEET | DEFLECTION LIMIT | 16 | 24 | 16 | 24 | 16 | 24 | 16 | 24 |
| 8 | L/240 | 1416 | 840 | 1371 | 805 | 1255 | 715 | 1147 | 631 |
| | L/360 | 1416 | 840 | 1371 | 805 | 1255 | 715 | 1147 | 631 |
| 9 | L/240 | 1219 | 684 | 1164 | 641 | 1023 | 531 | 893 | 430 |
| | L/360 | 1219 | — | 1164 | — | 1023 | — | 893 | — |
| 10 | L/240 | 1005 | 512 | 940 | 461 | 773 | 331 | 621 | 213 |
| | L/360 | 1005 | — | 940 | — | 773 | — | 621 | — |
| 11 | L/240 | 774 | 328 | 698 | 268 | 505 | — | 332 | — |
| | L/360 | 774 | — | 698 | — | 505 | — | 332 | — |
| 12 | L/240 | 527 | — | 441 | — | — | — | — | — |
| | L/360 | 527 | — | 441 | — | — | — | — | — |
| 13 | L/240 | 267 | — | — | — | — | — | — | — |
| | L/360 | — | — | — | — | — | — | — | — |

TABLE 2

LOAD TABLE FOR 1.0 × 2.0 TUBE
ALLOWABLE AXIAL (DEAD + SNOW) LOADS
ON EXTERIOR WALLS (PLF)
DENSITY = 1.0 PCF WALL THICKNESS = 10 IN WIND LOAD = 5 PSF
VIRGIN YIELD STRENGTH OF STEEL TUBE MATERIAL = 45000 PSI

| | | TUBE GAUGE | | | | | | | |
|---|---|---|---|---|---|---|---|---|---|
| | | 16 | | 17 | | 18 | | 19 | |
| | | TUBE SPACING (IN) | | | | | | | |
| HEIGHT FEET | DEFLECTION LIMIT | 16 | 24 | 16 | 24 | 16 | 24 | 16 | 24 |
| 8 | L/240 | 3241 | 2032 | 3187 | 1989 | 3047 | 1878 | 2915 | 1774 |
| | L/360 | 3241 | 2032 | 3187 | 1989 | 3047 | 1878 | 2915 | 1774 |
| 9 | L/240 | 3000 | 1838 | 2933 | 1785 | 2758 | 1646 | 2594 | 1517 |
| | L/360 | 3000 | 1838 | 2933 | 1785 | 2758 | 1646 | 2594 | 1517 |
| 10 | L/240 | 2733 | 1623 | 2652 | 1558 | 2440 | 1390 | 2242 | 1234 |
| | L/360 | 2733 | 1623 | 2652 | 1558 | 2440 | 1390 | 2242 | 1234 |
| 11 | L/240 | 2442 | 1388 | 2344 | 1311 | 2093 | 1112 | 1859 | 927 |
| | L/360 | 2442 | 1388 | 2344 | 1311 | 2093 | 1112 | 1859 | 927 |
| 12 | L/240 | 2126 | 1134 | 2012 | 1043 | 1719 | 811 | 1448 | 598 |
| | L/360 | 2126 | 1134 | 2012 | 1043 | 1719 | 811 | 1448 | 598 |
| 13 | L/240 | 1786 | 861 | 1655 | 756 | 1320 | 490 | 1011 | — |
| | L/360 | 1786 | 861 | 1655 | 756 | 1320 | 490 | 1011 | — |
| 14 | L/240 | 1425 | 569 | 1276 | 451 | 896 | — | 549 | — |
| | L/360 | 1425 | 569 | 1276 | 451 | 896 | — | 549 | — |
| 15 | L/240 | 1042 | — | 874 | — | — | — | — | — |
| | L/360 | 1042 | — | 874 | — | — | — | — | — |
| 16 | L/240 | 638 | — | — | — | — | — | — | — |
| | L/360 | 638 | — | — | — | — | — | — | — |

Corresponding tables are applicable to structures incorporating roll formed framing members.

Thus the new composite material is susceptible to conventional engineering design processes so that the load carrying characteristics of the various combinations of the steel and structural foam can be predicted from the types of materials used.

Thus it will be seen that in all forms of the present invention two well known and well accepted building materials, polystyrene and structural steel tubing, are combined to create modular building panels. This unique combination of materials gives a structural strength far exceeding all existing building code requirements.

The panels, when assembled into a complete unit, create a total thermal barrier between the exterior and interior of the building preventing the conduction of heat or moisture through the walls. Load bearing walls can be used instead of concrete block or stud wall construction and the roof panels can be used instead of wood or steel decks or instead of the normal ceiling and floor construction in a home.

Individual panels are designed to conform to individual load and stress requirements for different applications. This is accomplished by modifying the height, thickness and density of the polystrene and by changing the gauge and location of the steel reinforcing tubes.

By the use of the system of the present invention the erection time for walls can be reduced drammatically. For example the exterior walls of a two story house can be erected in only eight to 10 hours without the requirement of skilled labor.

Waste is totally eliminated using these panels saving both money and clean up time. Pilferage is also eliminated as the panels are delivered to the site and erected the same day.

The construction of interior walls of structural foam material results in similar savings in construction time with the added advantage of greatly reduced sound transmission between rooms. The basic material, polystyrene, is non-toxic and UL fire tested and, is impervious to mildew, moisture or rodent and pest attack. Because of these advantages builders can work year around in essentially any weather.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A fabricated composite load bearing panel serving as a building wall or the like comprising a plurality of modular elongated integral slabs of rigid foam insulating plastic material rectangular in section and each slab having two pairs of opposed surfaces, one pair of opposed surfaces having opposed substantially parallel recesses disposed centrally of said surfaces and extending from end to end thereof, splines of rigid foam heat insulating plastic material substantially filling said recesses and maintaining adjacent ones of said slabs in assembled relation with surfaces of adjacent slabs being disposed in full surface contact, certain of said slabs having an additional pair of laterally opposed substantially parallel recesses in the other pair of said surfaces, said additional recesses extending from end to end of said slabs, hollow tubular metal framing members securely surface bonded by adhesive means to said slabs and substantially occupying said additional recesses, said foam plastic material providing a thermal barrier between opposed framing members, and at least the outer surfaces of said framing members being flat and forming substantial continuations of said surfaces of said slabs.

2. The fabricated composite load bearing panel according to claim 1 wherein the upper edge of said panel has a central recess extending along its length, together with a rigid foam heat insulating plastic spline having a portion received within said central recess, and an additional portion projecting therefrom for attachment to a roof panel.

3. The fabricated composite load bearing panel according to claim 1 together with rigid perimeter framing strips disposed along the top and bottom edges of said slabs and being spaced apart in the direction of the thickness dimension of the slabs to provide a thermal break therebetween.

4. A fabricated composite loading bearing wall panel adapted to be covered on at least one of its surfaces with finishing panels of standard predetermined width, said panel comprising a plurality of modular elongated integral slabs of rigid foam heat insulating plastic material rectangular in section and each of said slabs having a width which is of predetermined fraction of said standard width, said slabs being rectangular in section and having two pairs of opposed surfaces, one pair of opposed surfaces having aopposed substantially parallel recesses disposed centrally of said surfaces and extending from end to end thereof, splines of rigid foam heat insulating plastic material substantially filling said recesses and maintaining adjacent ones of said slabs in assembled relation with the surfaces of adjacent slabs being disposed in full surface contact, certain of said slabs having an additional pair of laterally opposed substantially parallel recesses in the other of said surfaces, said additional recesses extending from end to end of said slabs, tubular metal framing members securely surface bonded by adhesive means to said slabs and substantially occupying said additional recesses, said foam plastic material providing a thermal barrier between opposed framing members, at least the outer surfaces of said framing members being flat and forming substantial continuations of said surfaces of said slabs, and selected ones of said slabs being assembled in edge to edge relation to establish a spacing between certain of said framing members equal to the width of said finishing panels to permit attachment of the edges of said finishing panels to said framing members.

5. A composite building structure comprising a plurality of load bearing wall panels and roof panels, each of said panels comprising a plurality of elongated planar slabs of rigid structural foam insulating material, each slab having a pair of major surfaces disposed on opposite sides, each said slab having a pair of recesses disposed along each of its longitudinal side edges to defice between them an integral tongue extending along said longitudinal side edge, each such tongue projecting outwardly from a mid thickness region of the slab, the slabs being in side by side relation with said tongues of the respective slabs being aligned in opposed abuting relationship and the adjacent recesses together defining opposed outwardly open grooves located at the junctions between the slabs, and a single rigid tubular framing member of polygonal section occupying each of said grooves, opposed pairs of the framing members serving to sandwich said abutting tongues of the adjacent slabs therebetween, means for adhesively bonding each framing member directly to the surface of said grooves, the tongues of the foam material serving to provide a thermal barrier between the metal framing members, each of the opposing ends of the planar slabs having a pair of perimeter framing strips extending therealong and spaced apart in the direction of the thickness dimension of the slabs to provide a thermal break therebetween, the opposing ends of the framing members being connected to associated ones of said pairs of perimeter framing strips so as to maintain the thermal break, the rigid framing members of the wall panels being disposed vertically and the rigid framing members of the roof panels spanning certain of said wall panels and being supported thereby, the perimeter framing strips of said load bearing wall panels being disposed along the top and bottom edges of such panels to form the caps and sills thereof, respectively, lowermost ones of the framing strips being secured to a floor slab, the wall panels being secured to one another at the corners of the building structure, and said roof panels resting on the top edges of adjacent pairs of the load bearing wall panels and being secured thereto, and means providing a protective skin layer overlying at least one of said major surfaces and each said framing member.

* * * * *